United States Patent [19]

Wilson

[11] Patent Number: 5,027,441

[45] Date of Patent: Jul. 2, 1991

[54] LADIES STOCKINGS

[76] Inventor: Reginald P. Wilson, 4580 Queen Mary Road, Montreal, Quebec, Canada, H3W 1W6

[21] Appl. No.: 426,585

[22] Filed: Oct. 25, 1989

Related U.S. Application Data

[63] Continuation-in-part of Ser. No. 200,748, May 31, 1988.

[51] Int. Cl.[5] ..... A41B 11/00; A41B 11/12

[52] U.S. Cl. ..... 2/240; 2/239; 2/241; 2/242; 2/303; 2/308; 2/309; 2/311; 2/336; 2/335

[58] Field of Search ..... 2/239, 240, 241, 242, 2/303, 308, 309, 311, 336, 335

[56] References Cited

U.S. PATENT DOCUMENTS

| | | | |
|---|---|---|---|
| 455,757 | 7/1891 | Lorentz | 2/240 |
| 712,941 | 11/1902 | Lamond | 2/240 |
| 1,257,856 | 2/1918 | Haun | 2/308 |
| 1,437,123 | 11/1922 | Wiechman | 2/240 |
| 1,480,385 | 1/1924 | Fraser | 2/240 |
| 1,762,601 | 6/1930 | Wall | 2/240 |
| 2,010,343 | 8/1935 | Barclay | 2/308 |
| 2,118,102 | 5/1938 | O'Connor | 2/240 |
| 2,687,532 | 8/1954 | Menz et al. | 2/240 |

FOREIGN PATENT DOCUMENTS

| | | | |
|---|---|---|---|
| 1402089 | 4/1964 | France | 2/240 |
| 316887 | 6/1930 | United Kingdom | 2/240 |
| 681823 | 10/1952 | United Kingdom | 2/240 |

*Primary Examiner*—Werner H. Schroeder
*Assistant Examiner*—Gloria Hale
*Attorney, Agent, or Firm*—Foley & Lardner

[57] ABSTRACT

The open end of a ladies stocking is in the shape of an inverted V, and an elasticized band is disposed adjacent to the peripheral edge of the open end.

9 Claims, 1 Drawing Sheet

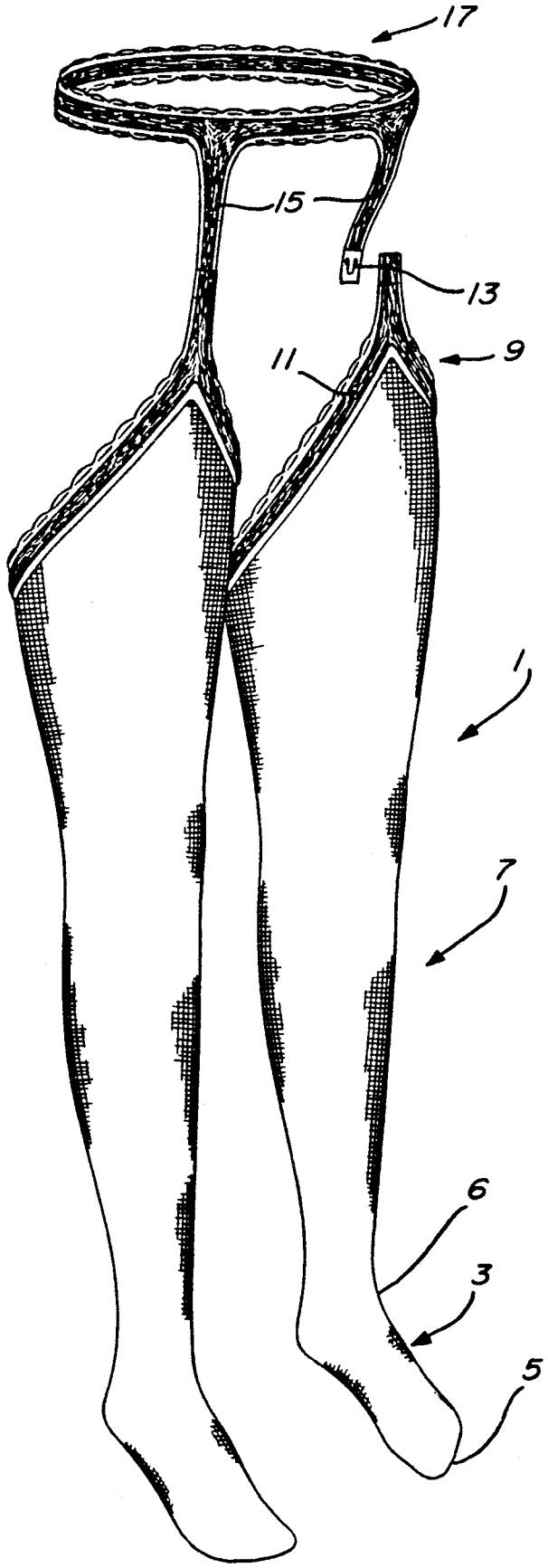
17
15
13
9
11
1
7
6
3
5

LADIES STOCKINGS

CROSS-REFERENCE TO RELATED APPLICATION

This application is a Continuation-In-Part of application Ser. No. 200,748, filed May 31, 1988.

BACKGROUND OF INVENTION

1. Field of the Invention

The invention relates to a novel stocking for ladies. More specifically, the invention relates to such a stocking which provides extra comfort by relieving, instead of causing, pressure along an elasticized open end thereof.

2. Description of Prior Art

It is known in the art to provide stockings having elasticized bands at the open ends thereof. Such stockings are illustrated in, for example, U.S. Pat. Nos. 3,625,029, Safrit et al, Dec. 7, 1971, 3,800,331, Taddeo, Apr. 2, 1974, 3,590,390, Howard et al, July 6, 1971, and 3,501,774 Norman, Mar. 24, 1970. The disadvantage of the prior art stockings is, when worn, the elasticized band contracts around the thigh of the wearer causing pressure and discomfort to the wearer.

It is known in the art to support ladies stockings by means of garter belts. A classic such garter belt has two straps extending down each leg of the user. One strap extends down the front of each leg, and the other strap extends down the back of each leg. When a user sits down, the rear strap will either bite into the skin of the user or be swept aside along the side of the leg to cause discomfort to the user. Thus, if an arrangement can be provided wherein the back strap of the garter belt is eliminated, then disadvantages of the prior art can be overcome.

U.S. Pat. No. 712,941, Lamond, Nov. 4, 1902 teaches a ladies stocking with an inverted V at the top front thereof. However, in accordance with Lamond, a casing D must be formed at the outer periphery of the stocking to encase a rubber band E. As can be appreciated, the casing, which is formed by folding over the end of the stocking and then sewing along the dotted line in FIG. 3 of Lamond, must be manufactured manually at a resultant very high cost. Accordingly, the structure as illustrated in Lamond does not constitute a practical commercial embodiment.

In addition, the lines of the inverted V are curved or arched rather than straight. Because the lines are curved, the total periphery at the upper edge of the stocking is greater than it would be if the lines of the V were straight. Thus, there is a greater opening at the top of the stocking so that the rear of the stocking will be looser and have greater tendency to fall down. This will cause discomfort to the wearer.

Finally, in Lamond, the supporter C is a separate element and does not constitute an elasticized continuation of the elastic band E.

SUMMARY OF INVENTION

It is an object of the invention to provide ladies stockings which overcome the disadvantages of the prior art stockings.

More specifically, it is an object of the invention to provide ladies stockings with elasticized bands which relieve, instead of causing, pressure along the elasticized open end thereof.

It is also an object of the invention to provide a garter belt and ladies stockings combination.

In accordance with the invention, the elasticized open end is in the shape of an inverted V.

In accordance with the invention, there is provided a ladies stocking comprising:

an elongated foot portion having a first, closed, end and a second, open, end;

an elongated tubular leg portion having a first end joined to said second end of said foot portion, and a second, open, end;

said second, open, end of said leg portion being in the shape of an inverted V; and a band of elasticized material attached to and extending upwardly from the peripheral edge of said open end of said leg portion;

and further including an elasticized garter support means extending from the point of said inverted V, said V having a pair of straight arms, said garter support means comprising a continuation of said band of elasticized material, and being formed integrally therewith.

BRIEF DESCRIPTION OF DRAWINGS

The invention will be better understood by an examination of the following description, together with the accompanying drawing, in which:

The single Figure illustrates the novel stockings in perspective and also illustrates a garter belt arrangement for supporting the stockings.

DESCRIPTION OF PREFERRED EMBODIMENTS

Referring to the drawing, the novel stocking in accordance with the invention, illustrated generally at 1, comprises a foot portion 3, having a first, closed, end 5 and a second, open, end 6. The stocking also includes an elongated tubular leg portion 7 having a first end connected to the second end of the elongated foot portion. The second end of the elongated tubular leg portion 9 is an open end and is in the shape of an inverted V. An elastic band 11 is disposed adjacent to the peripheral edge of the second opened leg of the leg portion. The elastic band is attached to and extends upwardly from the peripheral edge at the open end (top) of the stocking. Preferably, the elastic band is attached to the peripheral edge by being sewn directly thereto. However, the elastic band may be adhesively affixed to the peripheral open end.

The stocking may also include a garter attachment 13, which, as can be seen, is a continuation of the elastic band, for attachment to garters 15 of garter belt 17. Preferably, 13 is attached to 15 by hook and eye fasteners as shown in the drawing. However, velcro pads, or other means well known in the art, may be used for this purpose.

The garter belt 17 comprises a belt portion made of an elasticized material. Extending downwardly from the front of the belt portion are two straps 15 which are also made of elasticized material. Thus, in accordance with the present invention, the garter belt has only a single strap for each leg of the user.

In operation, when the stocking is worn as illustrated in the Figure, an upward pulling force is applied by the garters 15, through the garter support 13, to the elastic band. This force, because it is being applied to an elastic band, is evenly distributed over the entire band. Thus, a relatively small force will support the stocking from the single point as compared with prior art belts which required support at both the front and rear of the stockings, i.e., at two points. Provision of the elastic band at the peripheral edge ensures that the stocking will not crawl down at any part of the top edge but will remain smartly in place in spite of the single point support. At the same time, it will do so without requiring a strong enough stretch on the elastic band which will dig into the thigh of the wearer causing a blockage of blood circulation as well as other discomforts to the wearer as in the prior art stockings with elasticized bands as described in the above-identified U.S. patents.

Because the inventive stocking is suspended from a single point only, any mild pressure which would be felt by the user would be felt at the back of the leg only as, at the front of the leg, the stocking is being pulled away from the limb. At the back of the leg, the pressure is not "localized" around the limb, i.e., the elastic does not surround the limb in a "localized" manner. Thus, the pressure of the inventive stocking will not have a "tourniquet" effect as in some of the stockings of the prior art.

Furthermore, when sitting down, the garter belt does not operate as the single strap is only loosely connected to the stocking. When sitting down, the stocking is held up by the elastic band.

Thus, in accordance with the invention, there is provided a ladies stocking which is healthy and comfortable and which is aesthetic in that it does not fall down when being worn.

In a preferred embodiment, the stretch of the elasticized material forming the band, i.e., the increase in length of the elastic band when stretched while having a total stretch capacity of 100%, is less than or equal to 17½% in order to mitigate against excess contraction of the elasticized band when it is released to thereby dig into the thigh of the wearer.

Although a single embodiment has been described, this was for the purpose of illustrating, but not limiting, the invention. Various modifications, which will come readily to the mind of one skilled in the art, are within the scope of the invention as defined in the appended claims.

I claim:

1. A ladies stocking comprising:

an elongated foot portion having a first, closed, end and a second, open, end;

an elongated tubular leg portion having a first end joined to said second end of said foot portion, and a second, open, end;

said second, open, end of said leg portion being in the shape of an inverted V; and a band of elasticized material fixedly attached to and along the peripheral edge of said open end of said leg portion and extending upwardly therefrom;

and further including an elasticized garter support means extending from the point of said inverted V, said V having a pair of straight arms, said garter support means comprising a continuation of said band of the same elasticized material, and being formed integrally therewith.

2. A stocking as defined in claim 1 wherein said band of elasticized material is attached to said peripheral edge by being sewn directly to said peripheral edge.

3. A stocking as defined in claim 2 wherein the point of said inverted V is at the front of said stocking.

4. A stocking as defined in claim 3 wherein the stretch of the elasticized material is less or equal to 17½%.

5. In combination, a ladies stocking and a garter belt arrangement;

said ladies stocking comprising:

an elongated foot portion having a first, closed, end and a second, open, end;

an elongated tubular leg portion having a first end joined to said second end of said foot portion, and a second, open, end;

said second, open, end of said leg portion being in the shape of an inverted V;

a band of elasticized material fixedly attached to and along the peripheral edge of said open end of said leg portion and extending upwardly therefrom;

an elasticized garter support means extending from the point of said inverted V, said V having a pair of straight arms, said garter support means comprising a continuation of said band of the same elasticized material, and being formed integrally therewith;

said garter belt comprising two downwardly extending garters;

said garters being attachable to a separate one of said garter support means of a pair of stockings; and means for attaching said garter support means to said garters.

6. A combination as defined in claim 5 wherein said band of elasticized material is attached to said peripheral edge by being sewn directly to said peripheral edge.

7. A combination as defined in claim 6 wherein said means for attaching comprises hook and eye means.

8. A stocking as defined in claim 7 wherein the point of said inverted V is at the front of said stocking.

9. A stocking as defined in claim 8 wherein the stretch of the elasticized material is less or equal to 17½%.

* * * * *